US011008210B2

(12) United States Patent
Carapelli et al.

(10) Patent No.: US 11,008,210 B2
(45) Date of Patent: May 18, 2021

(54) FUEL DISPENSER WITH FRAUD DETECTING BREAKAWAY VALVE ASSEMBLY

(71) Applicant: Gilbarco Inc., Greensboro, NC (US)

(72) Inventors: Giovanni Carapelli, High Point, NC (US); Howard Myers, Greensboro, NC (US)

(73) Assignee: GILBARCO INC., Greensboro, NC (US)

( * ) Notice: Subject to any disclaimer, the term of this patent is extended or adjusted under 35 U.S.C. 154(b) by 81 days.

(21) Appl. No.: 16/179,373

(22) Filed: Nov. 2, 2018

(65) Prior Publication Data

US 2019/0135608 A1 May 9, 2019

Related U.S. Application Data

(60) Provisional application No. 62/581,363, filed on Nov. 3, 2017.

(51) Int. Cl.

| | |
|---|---|
| ***B67D 7/34*** | (2010.01) |
| ***B67D 7/08*** | (2010.01) |
| ***B67D 7/32*** | (2010.01) |
| ***B67D 7/04*** | (2010.01) |

(52) U.S. Cl.

CPC ..... *B67D 7/34* (2013.01); *B67D 7/04* (2013.01); *B67D 7/085* (2013.01); *B67D 7/3218* (2013.01); *B67D 7/348* (2013.01)

(58) Field of Classification Search

CPC . B67D 7/04; B67D 7/34; B67D 7/085; B67D 7/348; B67D 7/3218

See application file for complete search history.

(56) References Cited

U.S. PATENT DOCUMENTS

| | | | | |
|---|---|---|---|---|
| 5,040,577 | A | 8/1991 | Pope | |
| 5,954,080 | A | 9/1999 | Leatherman | |
| 6,435,204 | B2 | 8/2002 | White et al. | |
| 6,522,947 | B1 * | 2/2003 | Hartsell, Jr. ..... | G07F 13/025 700/241 |
| 6,763,974 | B1 | 7/2004 | Shermer et al. | |

(Continued)

OTHER PUBLICATIONS

International Search Report and Written Opinion dated Jan. 4, 2019 in corresponding international PCT application serial No. PCT/US2018/058990, all enclosed pages cited.

(Continued)

*Primary Examiner* — Timothy L Maust

(74) *Attorney, Agent, or Firm* — Nelson Mullins Riley & Scarborough LLP

(57) ABSTRACT

A fuel dispenser includes a fuel nozzle configured to be connected to a vehicle fuel system, fuel piping configured to transfer fuel from at least one fuel storage tank associated with the fuel dispenser through the fuel nozzle into the vehicle fuel system, and a fraud detection valve apparatus. The fraud detection valve apparatus includes a cutoff valve configured to selectively prevent flow of fuel, a flow sensor configured to sense a flow of fuel, and processing circuity. The processing circuitry is configured to receive an indication of flow of fuel through the fuel flow control valve apparatus, determine an authorization status, and in response to a determination of no authorization during flow, cause the cutoff valve apparatus to close.

16 Claims, 7 Drawing Sheets

(56) References Cited

U.S. PATENT DOCUMENTS

| | | | | |
|---|---|---|---|---|
| 6,899,131 | B1 * | 5/2005 | Carmack | F16L 37/32 137/614 |
| 7,028,561 | B2 * | 4/2006 | Robertson | F16K 37/0041 73/861.79 |
| 7,487,796 | B2 * | 2/2009 | Imler | F16L 37/004 137/614.04 |
| 8,291,928 | B2 | 10/2012 | Reid et al. | |
| 8,376,185 | B2 * | 2/2013 | Liebal | B67D 7/08 137/1 |
| 9,302,899 | B2 * | 4/2016 | Williams | G06F 17/00 |
| 9,496,920 | B2 | 11/2016 | Carapelli et al. | |
| 10,266,387 | B2 * | 4/2019 | Carapelli | B67D 7/222 |
| 2001/0001179 | A1 | 5/2001 | Healy | |
| 2004/0088122 | A1 * | 5/2004 | Nanaji | G07F 15/10 702/45 |
| 2009/0293989 | A1 | 12/2009 | Yang et al. | |
| 2011/0031267 | A1 * | 2/2011 | Liebal | B67D 7/08 222/1 |
| 2011/0284777 | A1 | 11/2011 | Pitchford et al. | |
| 2012/0150344 | A1 | 6/2012 | Jennings | |
| 2017/0283239 | A1 | 10/2017 | Carapelli et al. | |
| 2019/0135608 | A1 * | 5/2019 | Carapelli | B67D 7/3218 |

OTHER PUBLICATIONS

"Water Hero: P-100 Installation and Operation Manual," copyright Jun. 2018, all enclosed pages cited.

* cited by examiner

FUEL DISPENSER WITH FRAUD DETECTING BREAKAWAY VALVE ASSEMBLY

PRIORITY CLAIM

This application is based upon and claims the benefit of provisional application Ser. No. 62/581,363, filed Nov. 3, 2017, incorporated fully herein by reference for all purposes.

BACKGROUND

The present invention relates generally to equipment used in fuel dispensing environments. More specifically, embodiments of the present invention relate to a fuel dispenser with a fraud detecting breakaway valve assembly.

Typical fuel dispensers may be configured such that the fuel is constantly pressurized by a submersible turbine pump (STP) and flow is prevented by a flow control valve. The flow control valve may be normally closed and opened by energizing a solenoid. The valves are typically driven by the dispenser's "Pump Control Node" (PCN) through an appropriate interface which applies current to the solenoid. In certain cases, it is possible to bypass this controlled opening using "cheater" wiring across the normal control switch that forces the valve open regardless of the operating condition of the PCN. Fuel would flow in this situation simply by squeezing the nozzle lever. The resulting fuel flow would be "not authorized" (i.e., stolen) and not counted by the dispenser. (Even if the fuel was counted, it would not be stopped in currently-deployed dispenser systems.)

SUMMARY

The present invention recognizes and addresses various considerations of prior art constructions and methods. According to one aspect, a fuel dispenser is provided including a fuel nozzle configured to be connected to a vehicle fuel system, fuel piping configured to transfer fuel from at least one fuel storage tank associated with the fuel dispenser through the fuel nozzle into the vehicle fuel system, and a fraud detection valve apparatus. The fraud detection valve apparatus includes a cutoff valve closeable to prevent flow of fuel, a flow sensor configured to sense a flow of fuel, and processing circuity. The processing circuitry is configured to receive an indication of flow of fuel, determine an authorization status, and in response to a determination of no authorization during flow, cause the cutoff valve to close.

In another example embodiment, the present invention provides a fraud detection valve apparatus including a cutoff valve closeable to prevent flow of fuel, a flow sensor configured to sense a flow of fuel, and processing circuity. The processing circuitry is configured to receive an indication of flow of fuel, determine an authorization status, and in response to a determination of no authorization during flow, cause the cutoff valve to close.

Those skilled in the art will appreciate the scope of the present invention and realize additional aspects thereof after reading the following detailed description of preferred embodiments in association with the accompanying drawing figures.

BRIEF DESCRIPTION OF THE DRAWINGS

A full and enabling disclosure of the present invention, including the best mode thereof directed to one skilled in the art, is set forth in the specification, which makes reference to the appended drawings, in which.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the present disclosure including the appended claims and their equivalents.

Fuel dispensers typically include a breakaway valve assembly which is often positioned at or near the connection of a fuel hose to the dispenser. Traditional breakaways are mechanical devices that automatically close a valve to prevent flow or spillage of fuel and allow the hose to detach from the dispenser to prevent damage to the dispenser. In an example embodiment of the present invention, a breakaway valve assembly may be provided that also includes a flow sensor and a fuel flow cutoff valve. The breakaway valve assembly may also include processing circuitry configured to receive an indication of fuel flow from the flow sensor and determine if authorized fueling or unauthorized fueling is occurring. For example, the processing circuitry may receive an indication of payment from a controller of the dispenser. In response to fuel flow without authorization, the processing circuitry may cause the cutoff valve to close thus limiting or preventing unauthorized fueling.

In some embodiments, the fuel sensor may be configured to provide power to the processing circuitry and/or the cutoff valve. Additionally, the processing circuitry may be configured for wireless communication with the controller of the dispenser. As such, the breakaway valve assembly may not require any wired connections to the dispenser and/or controller. In some example embodiments, the breakaway device may include one or more energy storage elements (such as a battery or a supercapacitor). In addition, another power source, such as one or more solar cells, may be provided to provide energy to the energy storage element(s).

Some embodiments of the present invention may be particularly suitable for use with a fuel dispenser in a retail service station environment, and the below discussion will describe some preferred embodiments in that context. However, those of skill in the art will understand that the present invention is not so limited. In fact, it is contemplated that embodiments of the present invention may be used with any suitable fluid dispensing or fluid transfer equipment.

Example Fuel Dispenser

Figure 1:
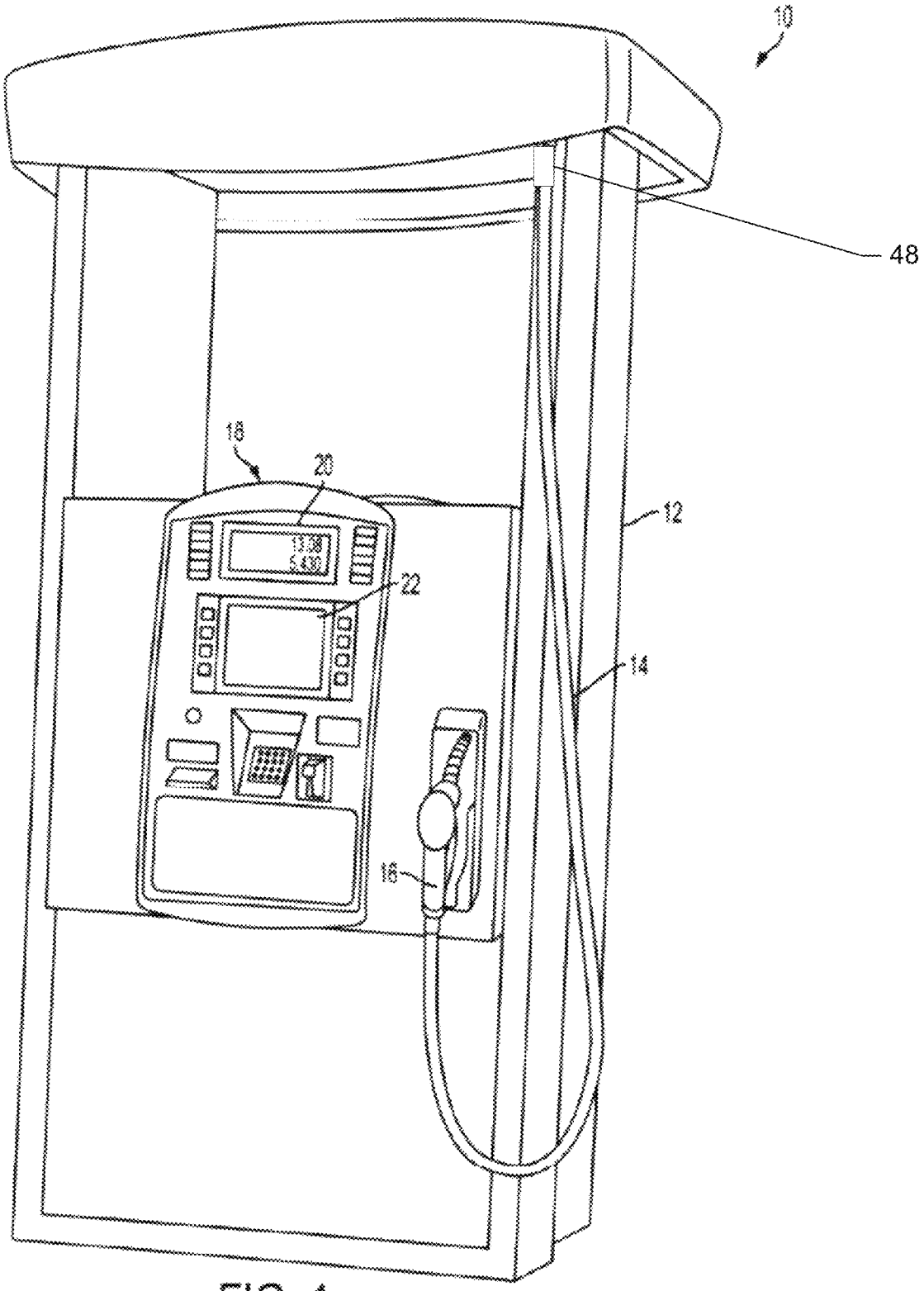
FIG. 1 illustrates a perspective view of an exemplary fuel dispenser in accordance with an embodiment of the present invention.

FIG. 1 is a perspective view of an exemplary fuel dispenser 10 according to an embodiment of the present invention. Fuel dispenser 10 includes a housing 12 with a flexible fuel hose 14 extending therefrom. Fuel hose 14 terminates in a fuel nozzle 16 adapted to be inserted into a fill neck of a vehicle's fuel tank. Fuel nozzle 16 includes a manually-operated fuel valve which the user typically opens by squeezing a lever. Various fuel handling components, such as valves and meters, are located inside of housing 12. These fuel handling components allow fuel to be received from underground piping and delivered through fuel hose 14 and fuel nozzle 16 to a vehicle's fuel system, e.g. fuel tank.

Fuel dispenser 10 has a customer interface 18. Customer interface 18 may include an information display 20 relating to an ongoing fueling transaction that includes the amount of fuel dispensed and the price of the dispensed fuel. Further, customer interface 18 may include a display 22 that provides instructions to the customer regarding the fueling transaction. Display 22 may also provide advertising, merchandising, and multimedia presentations to a customer, and may allow the customer to purchase goods and services other than fuel at the dispenser.

Figure 2:
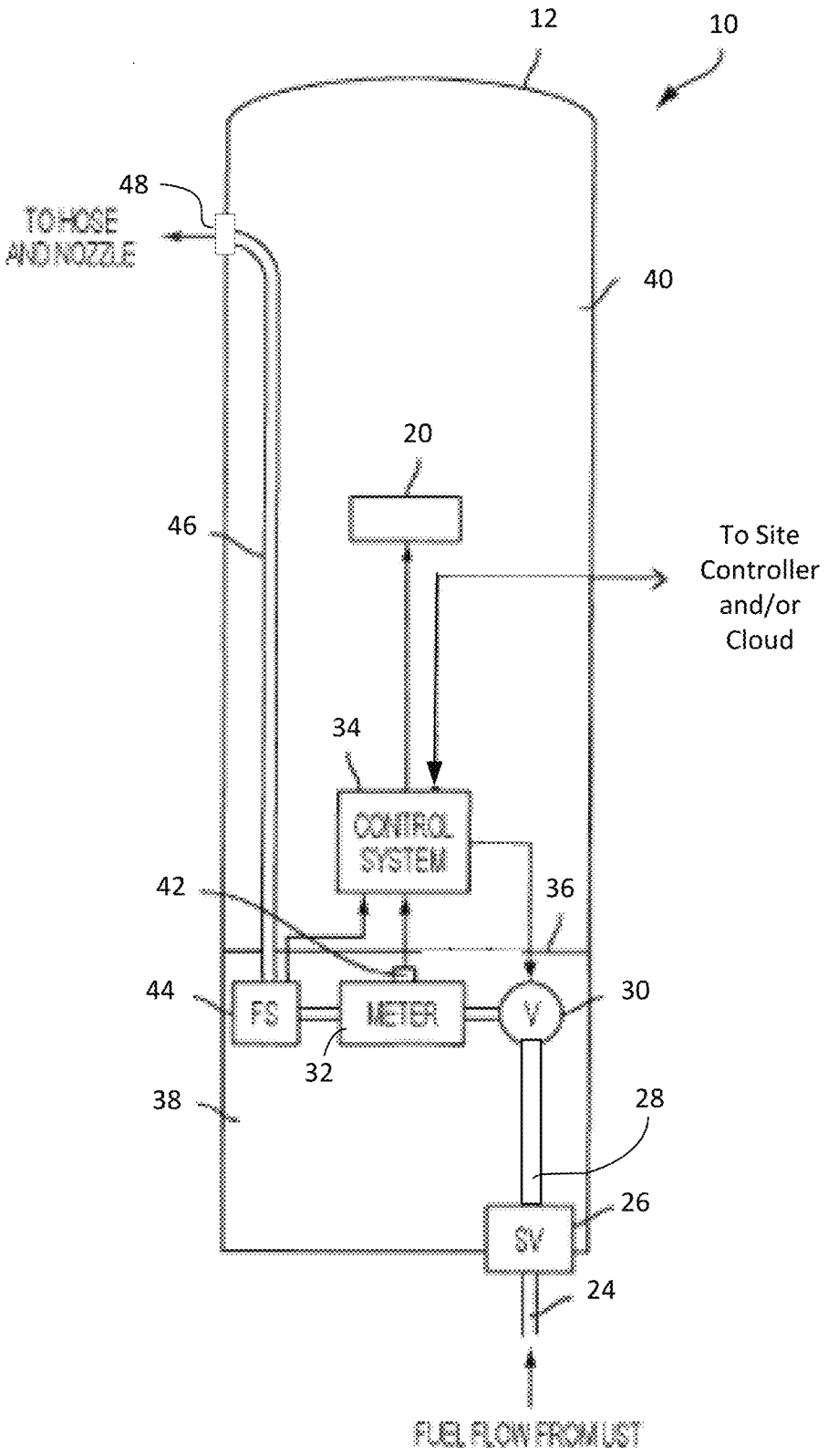
FIG. 2 illustrates a diagrammatic representation of internal components of the fuel dispenser of FIG. 1 according to an embodiment of the present invention.

FIG. 2 is a schematic illustration of internal fuel flow components of fuel dispenser 10 according to an embodiment of the present invention. In general, fuel may travel from an underground storage tank (UST) via main fuel piping 24, which may be a double-walled pipe having secondary containment as is well known, to fuel dispenser 10 and nozzle 16 for delivery. An exemplary underground fuel delivery system is illustrated in U.S. Pat. No. 6,435,204, hereby incorporated by reference in its entirety for all purposes. More specifically, a submersible turbine pump (STP) associated with the UST is used to pump fuel to the fuel dispenser 10. However, some fuel dispensers may be self-contained, meaning fuel is drawn to the fuel dispenser 10 by a pump unit positioned within housing 12.

Main fuel piping 24 passes into housing 12 through a shear valve 26. As is well known, shear valve 26 is designed to close the fuel flow path in the event of an impact to fuel dispenser 10. U.S. Pat. No. 8,291,928, hereby incorporated by reference in its entirety for all purposes, discloses an exemplary secondarily-contained shear valve adapted for use in service station environments. Shear valve 26 contains an internal fuel flow path to carry fuel from main fuel piping 24 to internal fuel piping 28.

Fuel from the shear valve 26 flows toward a flow control valve 30 positioned upstream of a flow meter 32. Alternatively, valve 30 may be positioned downstream of the flow meter 32. In one embodiment, valve 30 may be a proportional solenoid controlled valve, such as described in U.S. Pat. No. 5,954,080, hereby incorporated by reference in its entirety for all purposes.

Flow control valve 30 is under control of a control system 34. In this manner, control system 34 can control the opening and closing of flow control valve 30 to either allow fuel to flow or not flow through meter 32 and on to the hose 14 and nozzle 16. Control system 34 may comprise any suitable electronics with associated memory and software programs running thereon whether referred to as a processor, microprocessor, controller, microcontroller, or the like. In a preferred embodiment, control system 34 may be comparable to the microprocessor-based control systems used in CRIND (card reader in dispenser) type units sold by Gilbarco Inc. Control system 34 typically controls other aspects of fuel dispenser 10, such as valves, displays, and the like. For example, control system 34 includes a PCN which typically instructs flow control valve 30 to open when a fueling transaction is authorized. In addition, control system 34 may be in electronic communication with a point-of sale (POS) system (such as a site controller) located at the fueling site. The site controller communicates with control system 34 to control authorization of fueling transactions and other conventional activities. The control system 34 may also be in communication with one or more host servers in the "cloud," either directly or via the site controller.

A vapor barrier 36 delimits hydraulics compartment 38 of fuel dispenser 10, and control system 34 is located in electronics compartment 40 above vapor barrier 36. Fluid handling components, such as flow meter 32, are located in hydraulics compartment 38. In this regard, flow meter 32 may be any suitable flow meter known to those of skill in the art, including positive displacement, inferential, and Coriolis mass flow meters, among others. Meter 32 typically comprises electronics 42 that communicates information representative of the flow rate or volume to control system 34. For example, electronics 42 may typically include a pulser as known to those skilled in the art. In this manner, control system 34 can update the total gallons (or liters) dispensed and the price of the fuel dispensed on information display 20.

As fuel leaves flow meter 32 it enters a flow switch 44, which preferably comprises a one-way check valve that prevents rearward flow through fuel dispenser 10. Flow switch 44 provides a flow switch communication signal to control system 34 when fuel is flowing through flow meter 32. The flow switch communication signal indicates to control system 34 that fuel is actually flowing in the fuel delivery path and that subsequent signals from flow meter 32 are due to actual fuel flow. Fuel from flow switch 44 exits through internal fuel piping 46 to fuel hose 14 and nozzle 16 for delivery to the customer's vehicle. An example flow switch which may be utilized with embodiments of the present invention is shown and described in U.S. Pat. No. 6,763,974, incorporated fully herein by reference for all purposes.

In an example embodiment, a breakaway assembly 48 may connect the internal piping 46 to the hose 14. The breakaway assembly 48 has a separable portion that detaches from the dispenser 10 and/or internal piping 46 in response to a force that exceeds a predetermined threshold, for example 100 pounds or the like. For example, if a customer drives away with nozzle 16 still in the vehicle's fill neck, breakaway assembly 48 allows the nozzle and hose to separate from the remainder of dispenser 10. When this occurs, valves on both the separable portion and the remaining portion close to prevent loss of fuel. In an example embodiment, the breakaway assembly 48 may also include a fraud detection valve apparatus to prevent unauthorized fueling, as described below in reference to FIGS. 3 and 4.

A blend manifold may also be provided downstream of flow switch 44. The blend manifold receives fuels of varying octane levels from the various USTs and ensures that fuel of the octane level selected by the customer is delivered. In addition, fuel dispenser 10 may comprise a vapor recovery system to recover fuel vapors through nozzle 16 and hose 14 to return to the UST. An example of a vapor recovery assist equipped fuel dispenser is disclosed in U.S. Pat. No. 5,040,577, incorporated by reference herein in its entirety for all purposes.

Example Breakaway Assembly

Figure 3:
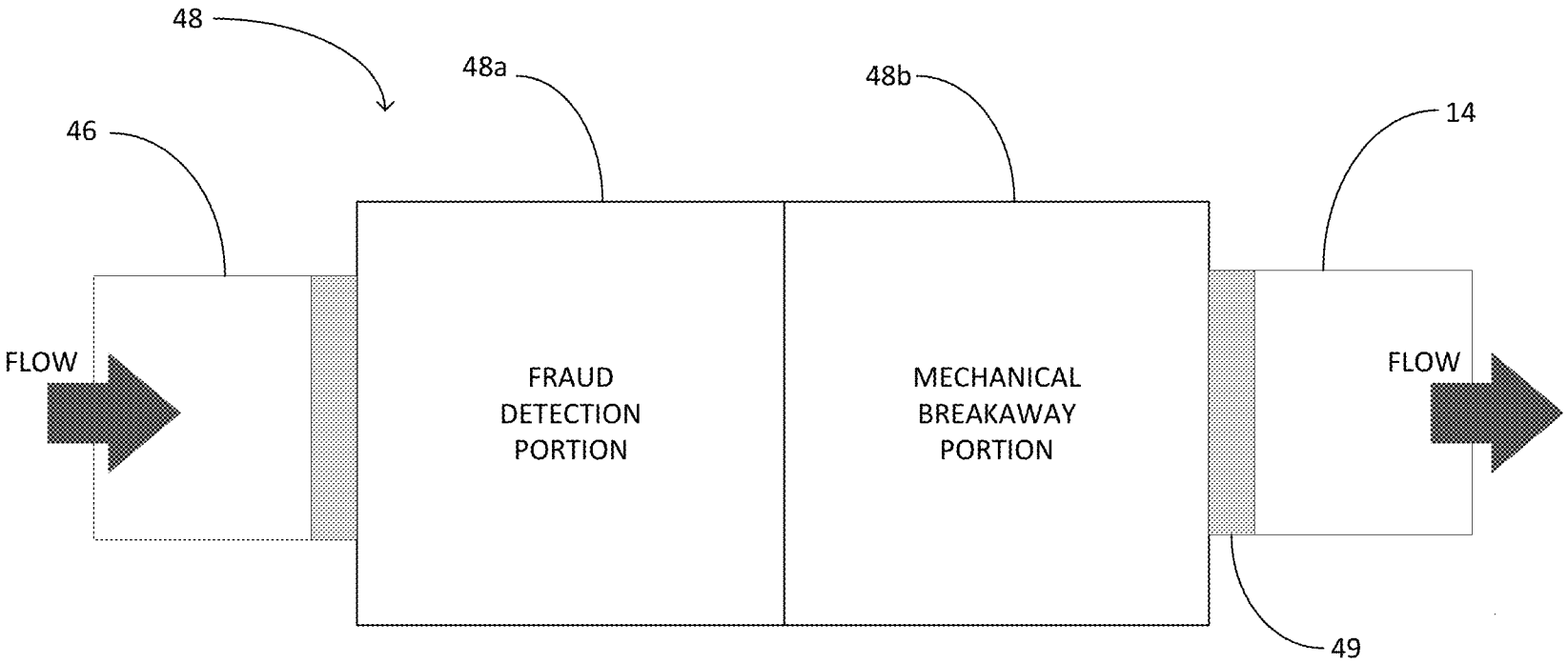
FIG. 3 is a diagrammatic representation of a breakaway valve assembly in accordance with an embodiment of the present invention.
Figure 4:
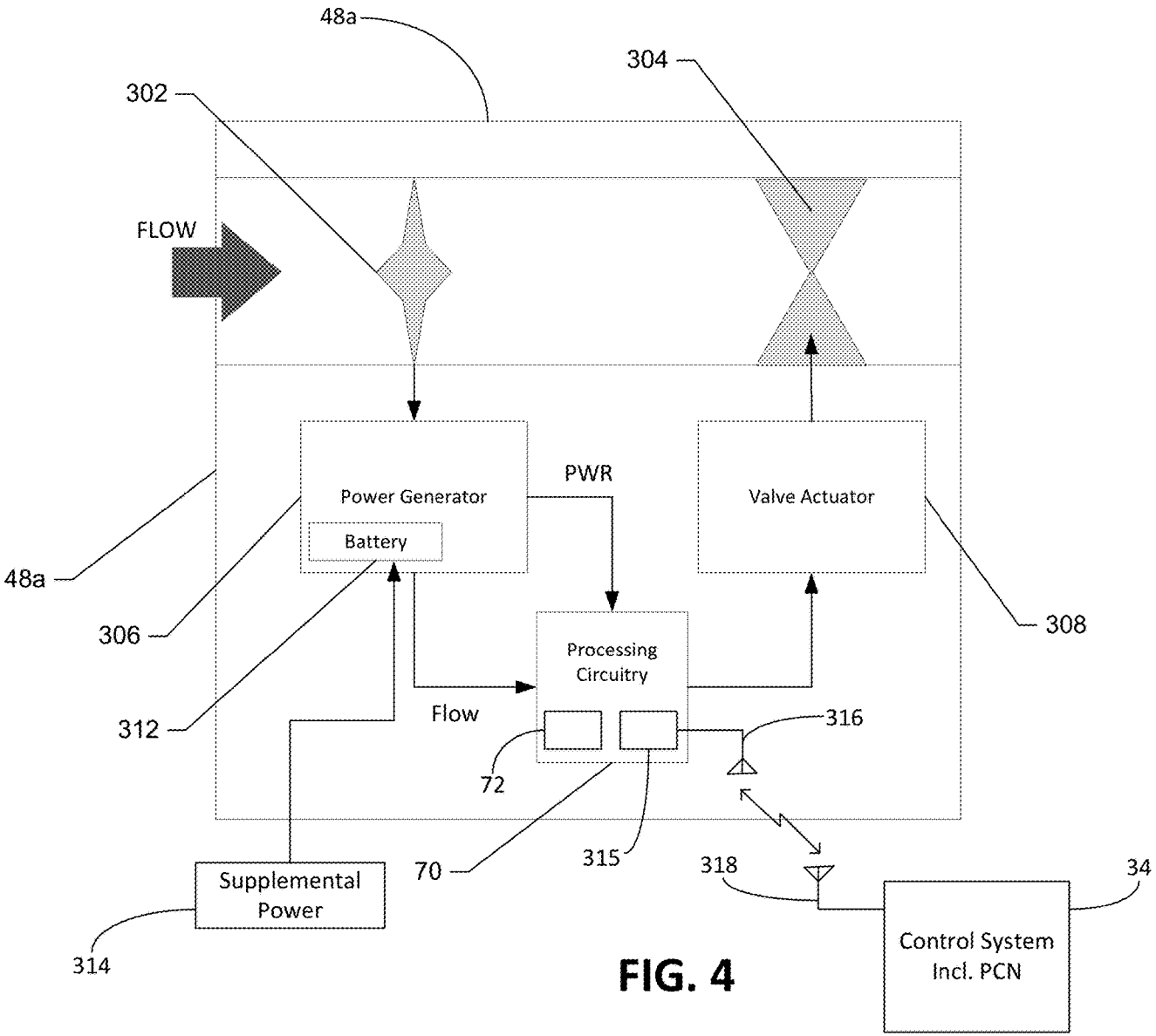
FIG. 4 diagrammatically illustrates components of the fraud detection portion of the breakaway valve assembly of FIG. 3 according to an embodiment of the present invention.

FIGS. 3 and 4 illustrate an example embodiment of a breakaway assembly 48 in accordance with the present invention. As shown in FIG. 3, breakaway assembly 48 in this embodiment includes a fraud detection portion 48*a* and a mechanical breakaway portion 48*b* which are preferably "packaged" together to have approximately the same overall size and shape as a traditional mechanical breakaway. In FIG. 3, flow of fuel occurs from left to right such that fuel passes through fraud detection portion 48*a* before entering mechanical breakaway portion 48*b*. Mechanical breakaway portion 48*b* may be configured having a known breakaway valve arrangement in which valves on both sides of an interface close when separation occurs. In this embodiment, mechanical breakaway portion 48*b* is adjacent hose 14 so that a lower cost mechanical portion will be carried with the hose and nozzle in the event of separation. U.S. Pat. No. 7,487,796, issued Feb. 10, 2009, and U.S. Pat. No. 6,899,131, issued May 31, 2005, disclose suitable mechanical breakaway valves that may be utilized in breakaway assembly 48. Both of the aforementioned patents are incorporated herein by reference in their entireties for all purposes. A suitable hose coupling 49 is provided to facilitate attachment of hose 14.

As shown in FIG. 4, fraud detection portion 48*a* includes a flow sensor 302, processing circuitry 70, a cutoff valve 304, and a valve actuator 308. The flow sensor 302 may be configured to measure or sense flow of a fluid, such as fuel, as the fuel passes from the internal piping 46 to the hose 14. The flow senor 302 may be any suitable device or mechanism for sensing the flow of the fluid. In preferred embodiments, the flow sensor 302 is configured as a turbine flow sensor that rotates in response to the fuel flow. In an example embodiment, the flow sensor 302 may be operably coupled to a power generator 306, together forming a magnet and coil arrangement, such that rotation of the flow sensor 302 causes electricity to be generated by the power generator 306. The electricity may be used to power processing circuitry 70 and/or the valve actuator 308. In some example embodiments, the power generator 306 may optionally include one or more energy storage components such as a battery 312 or a supercapacitor. For example, one or more rechargeable battery cells may be used to store electrical energy generated by the power generator 306 and supply electricity to the processing circuitry 70, such as when the flow sensor 302 is not rotating.

Additionally, or alternatively, the battery 312 and/or processing circuitry 70 may receive electrical power from another power source such as supplemental power source 314. The supplemental power source 314 may, for example, include one or more photovoltaic cells, e.g. solar cells, configured to generate electricity from sun light or artificial lighting, such as canopy lighting in a fueling environment.

The processing circuitry 70 may be configured to receive an indication of flow of fuel through the flow sensor 302. In addition, the processing circuitry 70 may be configured to determine whether the flow is due to an authorized event. In this regard, the determination of authorization may be in a status request in response to the indication of flow, a report from another device that a payment is authorized, or a continuous or periodic report or request. In some example embodiments, the processing circuitry 70 may request or receive authorization status from the control system 34 (e.g., the PCN), the POS, or the like. The authorization status may be binary, such as "1" for payment authorized for fueling and "0" for no payment authorized for fueling. In an example embodiment, the authorization data may be a portion of a command response between the control system 34 and the POS, which is intercepted by the processing circuitry 70 or is otherwise provided to the processing circuitry 70. The authorization data may be received wirelessly, such as via low energy Bluetooth or other suitable wireless communication methods, by the processing circuitry 70. In this way, the processing circuitry 70 is powered and can effectively communicate with control system 34 without the need to run wires to the breakaway assembly. Toward this end, processing circuitry 70 may be equipped with suitable radio electronics 315 including an antenna 316 for the transmission and receipt of wireless information. Similar radio electronics may be included in control system 34 (having its own antenna 318).

In response to a determination of no authorization at a time when fuel is flowing through the flow sensor 302, the processing circuitry 70 may be configured to cause the cutoff valve 304 to close. Preferably, the cutoff valve 304 will be normally opened but will close by operation of valve actuator 308. In this regard, the valve actuator 308 may be an electromechanical actuator such as a solenoid, servo motor, or the like. In some example embodiments, the cutoff valve 304 may include a biasing element configured to bias it toward the open position. For example, the biasing element may comprise a spring (such as a coil spring), configured to urge the cutoff valve to the open position when the valve actuator 308 is not actuated, e.g. the solenoid is deenergized.

In some example embodiments, the processing circuitry 70 may be configured to cause the cutoff valve 304 to open in response to determining that flow is now authorized. For example, if the processing circuitry 70 determines that unauthorized flow is occurring, the processing circuitry 70 may cause the cutoff valve 304 to close as discussed above. The cutoff valve 304 may remain closed until the processing circuitry 70 receives an indication of authorized fueling. In response to the processing circuitry 70 subsequently determining that authorization has occurred, the processing circuitry 70 may cause the fuel cutoff valve 304 to open (such as by simply allowing it to open in the case of a normally open valve).

In some instances, the processing circuitry 70 may receive control signals from remote computing devices, such as the POS, a remote server (e.g., in the "cloud"), or remote monitoring computer. The remote computing device may wirelessly communicate with the processing circuitry 70, such as to cause the processing circuitry 70 to actuate the valve actuator 308 to open and close the cutoff valve 304. Additionally, the processing circuitry 70 may cause flow data associated with the flow sensor 302 to be transmitted to the remote computing device, such as for monitoring and security purposes.

In some example embodiments, the processing circuitry 70 may be configured to cause an alert in response to causing the cutoff valve 304 to close. The alert may be an audio or visual indication such as an alarm, siren, flashing light, text or voice message, or the like. The alert may be sounded or displayed at the dispenser 10, within the fueling environment, or convenience store, at the remote computing device, or the like. In some instances, the alert may also cause one or more images of the dispenser's surrounding environment to be captured, which may include potential fraud perpetrators.

Figure 5:
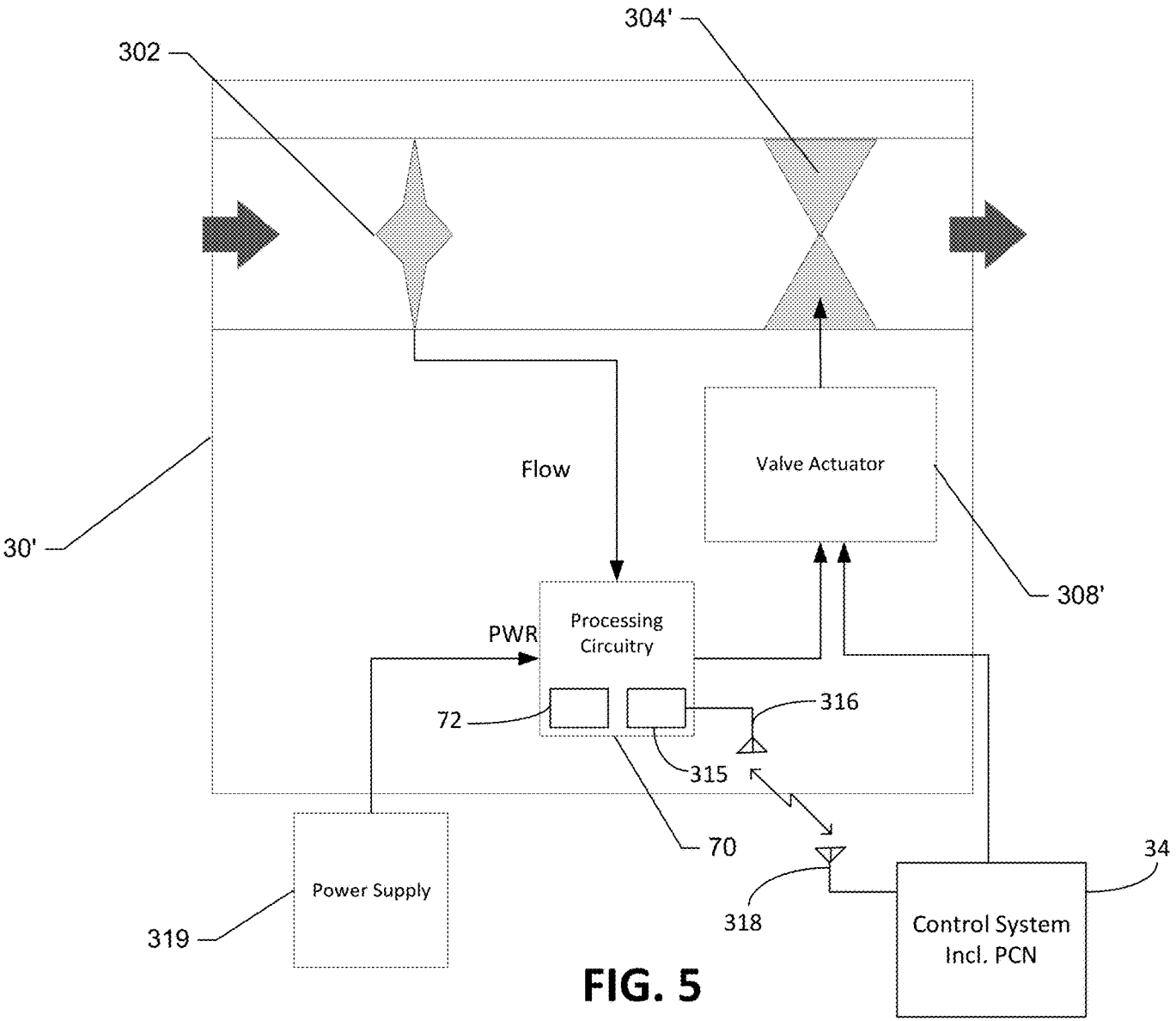
FIG. 5 is a diagrammatic representation of an alternative embodiment of a fraud detection valve apparatus in accordance with the present invention.

Although described herein as a portion of the breakaway assembly 48, one of ordinary skill in the art will appreciate that aspects of the fraud detection portion may be disposed in other locations internal or external to the dispenser 10 along the flow path of the internal piping 46 to provide a novel fraud detection valve apparatus in accordance with the present invention. In this regard, FIG. 5 shows an alternative embodiment in which flow control valve (designated 30') is itself modified to include aspects that were included in portion 48*a* described above. While energy harvesting might be employed in this embodiment as well, location of valve 30' inside of the fuel dispenser allows access to a power supply 319 also used to power other components of the fuel dispenser. In any case, however, flow sensor 302 is used to provide an indication to the processing circuitry 70 that flow is occurring. Like the embodiment of FIG. 4, processing circuitry 70 is in communication with control system 34 (either by wired or wireless connection) to determine whether the flow is authorized. In an example embodiment, the authorization data may in this case be indicated based on whether the flow control valve 30' is being energized by control system 34 to open. If the flow is not authorized, processing circuitry 70 can cause the regular proportional valve 304' to close via its associated actuator 308' independently and autonomously from the normal valve control signal of the PCN.

Example Processing Circuitry

Figure 6:
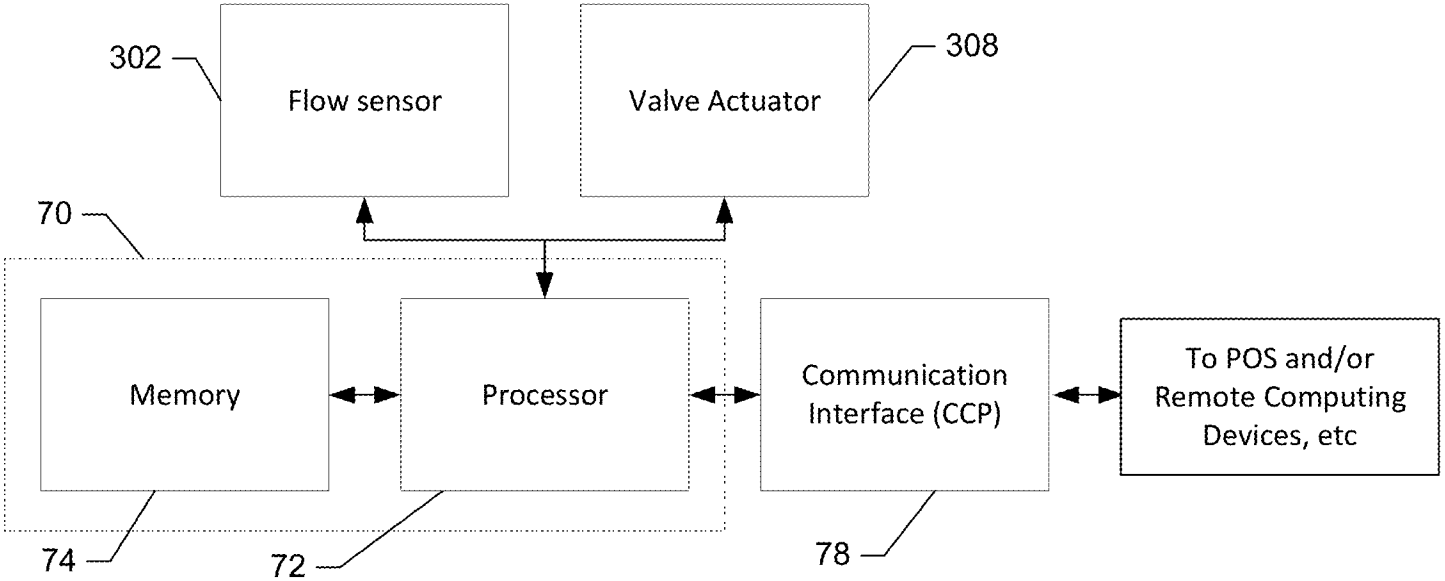
FIG. 6 illustrates a block diagram of one example of processing circuitry according to an embodiment of the present invention.

FIG. 6 shows certain elements of processing circuitry 70 according to an example embodiment. In an example embodiment, processing circuitry 70 is configured to perform data processing, application execution and other processing and management services. In this regard, the processing circuitry 70 may include a memory 74 and a processor 72 that may be in communication with or otherwise control a communication interface 78. As such, the processing circuitry 70 may be embodied as a circuit chip (e.g., an integrated circuit chip) configured (e.g., with hardware, software or a combination of hardware and software) to perform operations described herein. The communication interface 78 may be any suitable device or circuitry embodied in either hardware, software, or a combination of hardware and software that is configured to receive and/or transmit data from/to a network and/or any other device or module in communication with the control system 34 and/or the POS of the fueling environment (and/or a remote cloud server, either directly or via a router located in the convenience store). In some instances the communications interface 78 may be referred to as a cloud connection processor (CCP) and may provide secured, e.g. encrypted, communication between the processing circuity 70, the control system 34, and/or remote servers or remote computing devices. The communication interface 78 may also include, for example, an antenna (or multiple antennas) and supporting hardware and/or software for enabling communications with the other devices. In some environments, the communication interface 78 may alternatively or additionally support wired communication.

The processing circuitry 70 may also include or otherwise be in communication with the flow sensor 302 and/or the valve actuator 308. The processing circuitry 70 may receive an indication of flow of fuel through the fraud detection valve apparatus, e.g. through the flow sensor 302, determine an authorization status, and in response to a determination of no authorization and flow, cause the cutoff valve 304 to close, such as by actuating the valve actuator 308, as discussed above.

Processor 72 may preferably take the form of a secure microcontroller which is equipped with anti-tampering features. As a result, processor 72 will be able to avoid changes to the secure code controlling the cutoff mechanism. It can also contain cryptographic secrets that can be injected in factory and/or from a secure cloud connection. A connection to the cloud allows real time reporting of attempted fraud at the dispenser, as well as remote actuation of the fraud detection valve apparatus when appropriate.

Example Flowchart(s) and Operations

Embodiments of the present invention provide methods, apparatus and computer program products for fuel cutoff using a fraud detection valve apparatus in accordance with the present invention. Various examples of the operations performed in accordance with embodiments of the present invention will now be provided with reference to FIG. 7.

Figure 7:
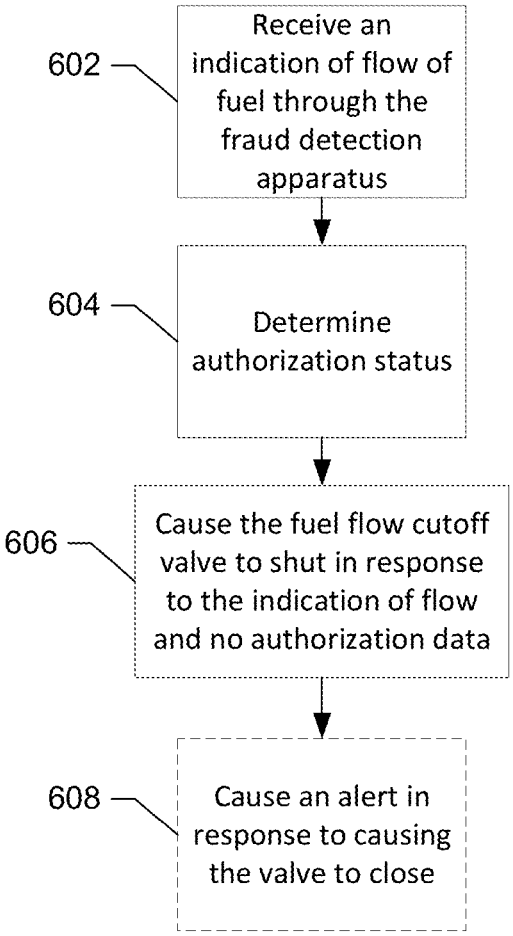
FIG. 7 illustrates a method of utilizing a fuel dispenser according to an example embodiment of the present invention.

FIG. 7 illustrates a flowchart according to an example method for fuel cutoff using a fraud detection valve apparatus according to an example embodiment. The operations illustrated in and described with respect to FIG. 7 may, for example, be performed by, with the assistance of, and/or under the control of one or more of the processor 72, memory 74, communication interface 78, flow sensor 302, and/or valve actuator 308. The method depicted in FIG. 7 may include receiving an indication of flow of fuel through the fraud detection valve at operation 602, determining an authorization status at operation 604, and causing the fraud detection valve to close in response to the indication of flow and no authorization data at operation 606.

In some embodiments, the method may include additional, optional operations, and/or the operations described above may be modified or augmented. Some examples of modifications, optional operations, and augmentations are described below, as indicated by dashed lines, such as, causing an alert in response to causing the cutoff valve to close at operation 608.

FIG. 7 illustrates a flowchart of a system, method, and computer program product according to an example embodiment. It will be understood that each block of the flowchart, and combinations of blocks in the flowchart, may be implemented by various means, such as hardware and/or a computer program product comprising one or more computer-readable mediums having computer readable program instructions stored thereon. For example, one or more of the procedures described herein may be embodied by computer program instructions of a computer program product. In this regard, the computer program product(s) which embody the procedures described herein may be stored by, for example, the memory 74 and executed by, for example, the processor 72. As will be appreciated, any such computer program product may be loaded onto a computer or other programmable apparatus (for example, the processing circuitry of the fraud detection valve apparatus) to produce a machine, such that the computer program product including the instructions which execute on the computer or other programmable apparatus creates means that implement the functions specified in the flowchart block(s). Further, the computer program product may comprise one or more non-transitory computer-readable mediums on which the computer program instructions may be stored such that the one or more computer-readable memories can direct a computer or other programmable device to cause a series of operations to be performed on the computer or other programmable apparatus to produce a computer-implemented process such that the instructions which execute on the computer or other programmable apparatus implement the functions specified in the flowchart block(s).

In some embodiments, the dispenser may be further configured for additional operations or optional modifications. In this regard, in an example embodiment, the fraud detection valve includes or is associated with a fuel hose breakaway valve configured to detach a fuel hose and close in response to a force applied by the fuel hose to the breakaway valve exceeding a predetermined force threshold. In an example embodiment, the flow sensor comprises a turbine flow sensor. In some example embodiments, the flow sensor is also configured to provide power to the processing circuitry. In an example embodiment, the cutoff valve comprises an electromechanical actuated valve. In some example embodiments, the cutoff valve closes when energized and opens when deenergized. In an example embodiment, the processing circuitry is further configured to cause the cutoff valve to open, in response to authorization. In some example embodiments, the payment or other authorization data is received wirelessly from a control system of the fuel dispenser. In an example embodiment, the processing circuitry is further configured to open or close the cutoff valve based on control signals from a remote computing device. In some example embodiments, the processing circuitry is further configured to cause an alert in response to causing the cutoff valve to close.

Many modifications and other embodiments of devices and/or methodology set forth herein will come to mind to one skilled in the art to which they pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

What is claimed is:

1. A fuel dispenser comprising:

a fuel nozzle configured to be connected to a vehicle fuel system;

fuel piping configured to transfer fuel from at least one fuel storage tank associated with the fuel dispenser through the fuel nozzle into the vehicle fuel system; and a fraud detection valve apparatus comprising:

a housing structure defining a flow passage;

a cutoff valve situated along the flow passage and closeable to selectively prevent flow of fuel;

a flow sensor situated along the flow passage and configured to sense a flow of fuel, wherein the flow sensor comprises a turbine flow sensor that is also configured to provide power to the processing circuitry; and processing circuitry configured to:

receive an indication of the flow of fuel through the flow passage detected by the flow sensor;

determine an authorization status; and in response to a determination of no authorization and flow, cause the cutoff valve to close.

2. The fuel dispenser of claim 1, wherein the fraud detection valve apparatus is incorporated into a breakaway assembly having a separable portion allowing disconnection of at least one of a fuel hose and the fuel nozzle at a predetermined pulling force, the breakaway assembly including at least one mechanical valve that closes when the separable portion is detached.

3. The fuel dispenser of claim 1, wherein the cutoff valve comprises an electromechanical actuated valve.

4. The fuel dispenser of claim 3, wherein the cutoff valve closes when energized and opens when deenergized.

5. The fuel dispenser of claim 1, wherein the processing circuitry is further configured to:

cause the cutoff valve to open, in response to authorization data.

6. The fuel dispenser of claim 1, wherein authorization data is received wirelessly from a control system of the fuel dispenser.

7. The fuel dispenser of claim 1, wherein the processing circuitry is further configured to open or close the cutoff valve based on control signals from a remote computing device.

8. The fuel dispenser of claim 1, wherein the processing circuitry is further configured to:

cause an alert in response to causing the cutoff valve to close.

9. A fraud detection valve apparatus comprising:

a housing structure defining a flow passage;

a cutoff valve situated along the flow passage and closeable to selectively prevent flow of fuel;

a flow sensor situated along the flow passage and configured to sense a flow of fuel, wherein the flow sensor comprises a turbine flow sensor that is also configured to provide power to the processing circuitry; and processing circuitry configured to:

receive an indication of the flow of fuel through the flow passage detected by the flow sensor;

determine an authorization status; and in response to a determination of no authorization and flow, cause the cutoff valve to close.

10. The fraud detection valve apparatus of claim 9, wherein the fraud detection valve apparatus is incorporated into a breakaway assembly having a separable portion allowing disconnection of at least one of a fuel hose and a nozzle at a predetermined pulling force, the breakaway assembly including at least one mechanical valve that closes when the separable portion is detached.

11. The fraud detection valve apparatus of claim 9, wherein the cutoff valve comprises an electromechanical actuated valve.

12. The fraud detection valve apparatus of claim 11, wherein the cutoff valve closes when energized and opens when deenergized.

13. The fraud detection valve apparatus of claim 9, wherein the processing circuitry is further configured to:

cause the cutoff valve to open, in response to authorization data.

14. The fraud detection valve apparatus of claim 9, wherein authorization data is received wirelessly from a control system of the fuel dispenser.

15. The fraud detection valve apparatus of claim 9, wherein the processing circuitry is further configured to open or close the cutoff valve based on control signals from a remote computing device.

16. The fraud detection valve apparatus of claim 9, wherein the processing circuitry is further configured to:

cause an alert in response to causing the cutoff valve to close.

* * * * *